US012638192B2

(12) United States Patent
Joe et al.

(10) Patent No.: US 12,638,192 B2
(45) Date of Patent: May 26, 2026

(54) BOILER AND METHOD FOR STAGE CHANGE CONTROL THEREOF

(71) Applicant: KYUNGDONG NAVIEN CO., LTD., Pyeongtaek-si (KR)

(72) Inventors: Min Gun Joe, Seoul (KR); Hyuk Choi, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 835 days.

(21) Appl. No.: 17/944,823

(22) Filed: Sep. 14, 2022

(65) Prior Publication Data

US 2023/0204226 A1 Jun. 29, 2023

(30) Foreign Application Priority Data

Dec. 23, 2021 (KR) ..... 10-2021-0185959

(51) Int. Cl.

| | |
|---|---|
| ***F24D 19/10*** | (2006.01) |
| ***F23N 5/26*** | (2006.01) |
| ***F24H 1/00*** | (2022.01) |
| ***F24H 1/10*** | (2022.01) |
| ***F24H 9/20*** | (2022.01) |
| ***F24H 15/174*** | (2022.01) |
| ***F24H 15/18*** | (2022.01) |
| ***F24H 15/35*** | (2022.01) |
| ***F24H 15/36*** | (2022.01) |

(Continued)

(52) U.S. Cl.

CPC ..... *F24D 19/1051* (2013.01); *F23N 5/265* (2013.01); *F24H 1/0027* (2013.01); *F24H 1/107* (2013.01); *F24H 9/2035* (2013.01); *F24H 15/174* (2022.01); *F24H 15/35* (2022.01); *F24H 15/36* (2022.01); *F24H 15/365* (2022.01); *F23N 2237/10* (2020.01); *F24H 15/176* (2022.01); *F24H 15/18* (2022.01)

(58) Field of Classification Search

CPC .. F24D 19/1051; F23N 5/265; F23N 2237/10; F24H 1/0027; F24H 1/107; F24H 9/2035; F24H 15/174; F24H 15/35; F24H 15/36; F24H 15/365; F24H 15/176; F24H 15/18

See application file for complete search history.

(56) References Cited

FOREIGN PATENT DOCUMENTS

| | | | |
|---|---|---|---|
| JP | H09243059 A | | 9/1997 |
| JP | 2003014297 A | * | 1/2003 |
| JP | 2020085397 A | | 6/2020 |

OTHER PUBLICATIONS

JP-2003014297-A translation (Year: 2003).*

(Continued)

*Primary Examiner* — Michael G Hoang
*Assistant Examiner* — Kurt J Wolford
(74) *Attorney, Agent, or Firm* — ALG Intellectual Property, LLC

(57) ABSTRACT

Provided are a boiler and a method for stage change control of the boiler. The boiler includes a burner to generate a calorie necessary for producing hot water by burning air and gas, and a controller to perform a stage change control operation, when the number of times, in which the stage is changed, is equal to or greater than a reference number of times, for a predetermined time, based on information on occurrence of the change of the stage in the burner, while hot water is used.

14 Claims, 12 Drawing Sheets

(51) Int. Cl.
*F24H 15/365* (2022.01)
*F24H 15/176* (2022.01)

(56) References Cited

OTHER PUBLICATIONS

"Upon" definitiion (Year: 2025).*
Office Action issued in Korean Patent Application No. KR 10-2021-0185959 on Nov. 26, 2024.
"Search Report received in application GB2213117.1, dated Feb. 21, 2023".

* cited by examiner

BOILER AND METHOD FOR STAGE CHANGE CONTROL THEREOF

CROSS-REFERENCE TO RELATED APPLICATION

This application claims the benefit of priority to Korean Patent Application No. 10-2021-0185959, filed in the Korean Intellectual Property Office on Dec. 23, 2021, the entire contents of which are incorporated herein by reference.

TECHNICAL FIELD

The present disclosure relates to a boiler and a method for stage change control thereof.

BACKGROUND

A boiler has been employed for heating or for supplying hot water at general home and a public building. In general, a boiler burns oil or gas serving as fuel, heats water by using combustion heat generated in a heating process. And the heated water is circulated interior to heat the interior, or is supplied hot water to a user.

A typical boiler for heating and supplying hot water may include a heating heat exchanger to heat water using combustion heat of a burner, a three-way valve to switch a flow path to be in a heating mode or a hot water mode, a boiler circulation pump to circulate water, and a hot water heat exchanger to supply hot water by performing heat-exchange with respect to direct water.

A conventional boiler for heating and hot water includes a burner installed in a heat exchanger for heating to make combustion when the mixture of the air and the gas is ignited, heats water using high-temperature combustion gas, and allows the heated water to circulate an interior, such that the interior is heated.

In addition, when the hot water is used, heating water is switched to the heat-exchanger for hot water and used as a heating source to heat, as hot water, direct water, which is supplied from a direct water pipe, through heat-exchange, such that the hot water is supplied to a customer through a hot water pipe.

However, a conventional boiler for hot water and heating performs a mixing control operation by adjusting the mixing rate of hot water and direct water through a mixing valve linked to a direct water pipe such that the temperature of the hot water supplied to a customer is adjusted when the hot water is used. The variation of control calorie is increased depending on the rapid change in the temperature, which is made due to the difference in flow rate of water introduced into a heat exchanger for hot water during the mixing control operation. Accordingly, a stage is frequently changed in an overlap section in which ranges of control calorie required in individual stages of the burner are overlapped, and calorie is dropped due to the variation of the calorie.

In addition, a stage is frequently changed in the overlap duration depending on a water replenishment state of a boiler, the consumption variation of the burner, and the flow rate.

SUMMARY

The present disclosure has been made to solve the above-mentioned problems occurring in the prior art while advantages achieved by the prior art are maintained intact.

An aspect of the present disclosure provides a boiler, capable of preventing a stage from being frequently changed and calorie from being dropped when hot water is used in the boiler, and a method for stage change control thereof Another aspect of the present disclosure provides a boiler, capable of stably changing a stage without correcting a cause of frequently changing the stage or of dropping calorie, or adding a part, when hot water of the boiler is used, and a method for stage change control thereof.

The technical problems to be solved by the present disclosure are not limited to the aforementioned problems, and any other technical problems not mentioned herein will be clearly understood from the following description by those skilled in the art to which the present disclosure pertains.

According to an aspect of the present disclosure, a boiler may include a burner configured to generate a calorie necessary for producing hot water by burning air and gas, and a controller configured to perform a stage change control operation, when the number of times, in which the stage is changed, is equal to or greater than a reference number of times, for a predetermined time, based on information on occurrence of the change of the stage in the burner, while hot water is used.

According to an embodiment, the burner may be driven in multiple stages, and generates a calorie corresponding to a number of a stage in which the burner is driven.

According to an embodiment, the controller may store the information on the occurrence of the change of the stage, whenever the change of the stage occurs in the burner, from a time point at which a first time is elapsed after the burner starts burning.

According to an embodiment, the controller may maintain a present control state when the number of times, in which the stage of the burner is changed for the latest second time from a current time point, is determined as being less than a first count, based on the stored information on the occurrence of the change of the stage, and perform the stage change control operation, when the number of times, in which the stage is changed, is equal to or greater than the first count.

According to an embodiment, the controller may perform the stage change control operation when the stage of the burner is changed from a first stage to a second stage.

According to an embodiment, the controller may perform a first control operation until a reference time is elapsed from a time point at which the stage change control operation is started, and perform a second control operation after the reference time is elapsed.

According to an embodiment, the controller may change a target revolution per minute (RPM) of a blowing fan, which supplies the air to the burner, to a second stage control RPM from a first stage control RPM while maintaining the stage of the burner to the first stage, when the first control operation is performed, According to an embodiment, the controller may maintain the target RPM of the blowing fan to the second stage control RPM and change the stage of the burner to the second stage from the first stage, when the second control operation is performed.

According to an embodiment, the controller may control the calorie by considering a current gain, when the second control operation is performed, and exclude the current gain in controlling the calorie, when the calorie is controlled to a reference value or more, while the stage of the burner is changed from the first stage to the second stage.

According to an embodiment, the controller may release the stage change control operation when the number of times, in which the stage of the burner is changed for the latest second time from the current time point, is equal to or less than a second count, while the stage change control operation is performed.

According to another aspect of the present disclosure, a method for changing a stage of a boiler, may include generating, by a burner, a calorie necessary for producing hot water by burning air and gas, and performing the stage change control operation, when the number of times, in which the stage is changed, is equal to or greater than a reference number of times, for a predetermined time, based on information on occurrence of the change of the stage in the burner, while hot water is used.

According to an embodiment, the generating of the calorie may include driving the burner in multiple stages, and generating a calorie corresponding to a number of a stage in which the burner is driven.

According to an embodiment, the method may further include storing the information on the occurrence of the change of the stage, whenever the change of the stage occurs in the burner, from a time point at which a first time is elapsed after the burner starts burning.

According to an embodiment, the performing the stage change control operation may include maintaining a present control state when the number of times, in which the stage of the burner is changed for the latest second time from a current time point, is determined as being less than a first count, based on the stored information on the occurrence of the change of the stage, and performing the stage change control operation, when the number of times, in which the stage is changed, is equal to or greater than the first count.

According to an embodiment, the performing the stage change control operation may include performing the stage change control operation, when the stage of the burner is changed from a first stage to a second stage.

According to an embodiment, the performing the stage change control operation may include performing a first control operation until a reference time is elapsed from a time point at which the stage change control operation is started, and performing a second control operation after the reference time is elapsed.

According to an embodiment, the performing the first control operation may include changing a target revolution per minute (RPM) of a blowing fan, which supplies the air to the burner, to a second stage control RPM from a first stage control RPM while maintaining the stage of the burner to the first stage.

According to an embodiment, the performing the second control operation may include maintaining the target RPM of the blowing fan to the second stage control RPM and changing the stage of the burner to the second stage from the first stage.

According to an embodiment, the performing the second control operation may include controlling the calorie by considering a current gain, and excluding the current gain in controlling the calorie, when the calorie is controlled to a reference value or more, while the stage of the burner is changed from the first stage to the second stage.

According to an embodiment, the method may further include releasing the stage change control operation when the number of times, in which the stage of the burner is changed for the latest second time from the current time point, is equal to or less than a second count, while the stage change control operation is performed.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
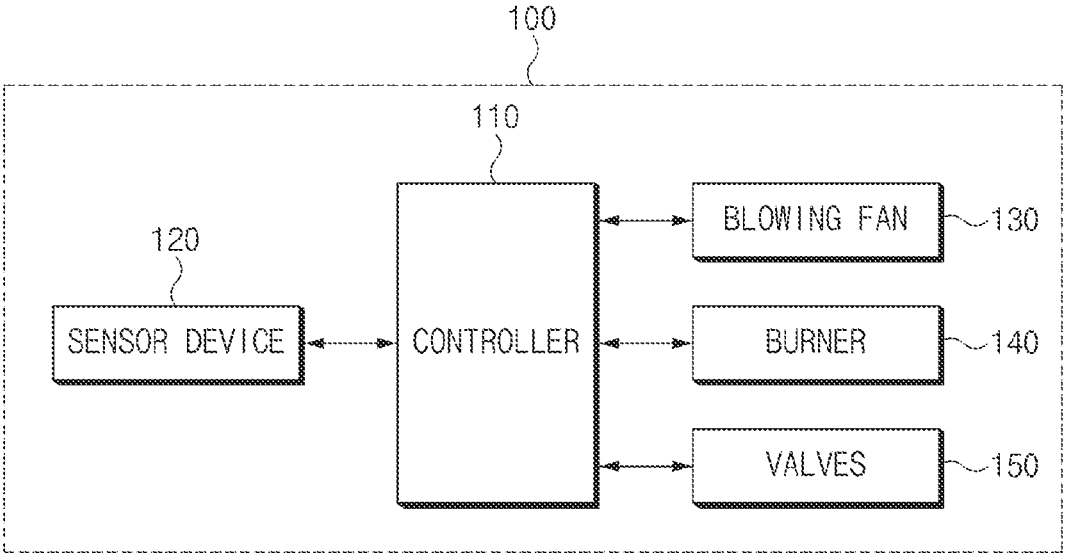
FIG. 1 is a view schematically illustrating the structure of a boiler, according to an embodiment of the present disclosure.

Hereinafter, some embodiments of the present disclosure will be described in detail with reference to the accompanying drawings. In adding the reference numerals to the components of each drawing, it should be noted that the identical or equivalent component is designated by the identical numeral even when they are displayed on other drawings. Further, in describing the embodiment of the present disclosure, a detailed description of well-known features or functions will be ruled out in order not to unnecessarily obscure the gist of the present disclosure.

In addition, in the following description of components according to an embodiment of the present disclosure, the terms 'first', 'second', 'A', 'B', '(a)', and '(b)' may be used. These terms are merely intended to distinguish one component from another component, and the terms do not limit the nature, sequence or order of the constituent components. In addition, unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

The present disclosure relates to a boiler and a method for stage change control of the boiler. According to the present disclosure, the boiler may correspond to a boiler for heating and hot water.

FIG. 1 is a view schematically illustrating the structure of a boiler, according to an embodiment of the present disclosure.

Referring to FIG. 1, a boiler 100 may include a controller 110, a sensor device 120, a blowing fan 130, a burner 140, and valves 150.

The controller 110 may be a hardware device, such as a processor or a central processing unit (CPU), or a program implemented by the processor. The controller 110 may be connected to each component of the boiler to perform an overall function of the boiler.

For example, the controller 110 may execute operation or data processing associated with control and/or communication of the components included in the boiler 100. In addition, the controller 110 may sense a temperature and a flow rate through various sensors provided in the boiler 100 and may control the blowing fan 130, the burner 140, and the valves 150 based on the sensing result.

The sensor device 120 may include various sensors provided in the boiler 100. For example, the sensor device 120 may include a direct water flow rate sensor, a direct water temperature sensor, and a hot water temperature sensor.

The blowing fan 130 suctions external air and supplies the external air to the burner 140. The revolutions per minute (RPM) of the blowing fan 130 may be controlled by the controller 110.

Accordingly, the controller 110 determines the RPM of the blowing fan 130, which corresponds to required calorie, and controls the blowing fan 130 based on the determined RPM. For example, the controller 110 may calculate required calorie for a stage to be controlled in the burner 140 when hot water is used, and may control the blowing fan 130 based on the RPM which is determined to correspond to the required calorie calculated.

Accordingly, the burner 140 generate required calorie necessary for producing hot water by mixing air suctioned by the blowing fan 130 and gas, and by burning the mixture. For example, the burner 140 may be installed in a heat exchanger (not illustrated) for heating. Accordingly, the burner 140 may directly provide heat which is necessary for producing the hot water in the heat exchanger for heating.

Meanwhile, the burner 140 may indirectly provide heat by introducing hot water, which is heated by the burner 140, into a heat exchanger (not illustrated) for hot water, such that the hot water is produced through heat-exchange.

In this case, the burner 140 may be driven with plural stage number. For example, the burner 140 may be driven in one stage or two stages. According to an embodiment, the burner 140 may be driven in two stages or more. To this end, the burner 140 may include a plurality of burner units (not illustrated) and the number of burner units operating may be adjusted based on the stage number. For example, 'n' number of burner units operate in one stage, and '2n' number of burner units operate in two stages.

Accordingly, the controller 110 may control a stage number for driving of the burner 140, depending on the operating state of the boiler 100.

The valves 150 may include a gas supply valve (not illustrated) and a mixing valve (not illustrated).

The gas supply valve adjusts an amount of gas supplied to the burner 140, such that the gas is supplied while the blowing fan 130 supplies air to the burner 140. The open value of the gas supply valve may be adjusted by the controller 110.

Accordingly, the controller 110 may determine the ratio between an air amount and a gas amount, depending on the required calorie, and may adjust the open value of the gas supply valve, based on the determined gas amount.

The mixing valve is mounted in a mixing pipe (not illustrated), which links a direct pipe and a hot water pipe of the boiler 100 to each other, to adjust an amount of direct water to be mixed with a hot water discharged from a hot water heat exchanger to flow through the hot water pipe. The open value of the mixing valve may be adjusted by the controller 110.

Accordingly, the controller 110 may determine the temperature of first hot water, which is hot water before mixed with the direct water, the temperature of second hot water which is hot water after mixed with the direct water, and the temperature of the direct water, may determine the ratio between an amount of the first hot water and an amount of the direct water, such that a second temperature becomes a target temperature, and may adjust the open value of the mixing valve, based on the determined amount of direct water.

The controller 110 counts the number of times (hereinafter, a stage change count), in which a stage of the burner 140 is changed, from a time point at which a first time 'T1' is elapsed after burning is started, to prevent the stage from being frequently changed in an overlap section in which control calorie ranges of a first stage and a second stage are overlapped. To this end, the controller 110 may store information on occurrence of the change of the stage, whenever the stage is changed.

For example, on the assumption that the maximum control calorie of the first stage is 41%, the minimum control calorie of the second stage is 31%, the 31% to 41% section is the section in which the control calorie of the first stage and the control calorie of the second stage are overlapped. Accordingly, the stage may be frequently changed between the first stage and the second stage.

The controller 110 may maintain a present control state when the stage change count is determined as being less than a first count (N1) for the latest second time (T2) from a current time point, based on the stored information on the occurrence of the change of the stage, and may control the change of the stage (hereinafter, a stage change control operation), when the stage change count is determined as being equal to or greater than the first count (N1).

In this case, the stage change control operation may be performed only with respect to the change (stage change) of the stage from the first stage to the second stage. Accordingly, the controller 110 may perform a first control operation until a reference time is elapsed from the time point at which the stage change control operation is started, and may perform a second control operation after the reference time is elapsed, when the stage change control operation is performed.

The controller 110 employs a target RPM of the blowing fan 130 to a second control RPM (low-power RPM), and maintains the stage of the burner 140 to the first stage, when a first control operation is performed. In addition, the controller 110 excludes a current gain in controlling calorie, when the first control operation is performed. In this case, the wording "the controller 110 excludes the current gain in controlling calorie" refers to that the current gains is excluded from items for deriving the control calorie. The calorie is proportional to a current. When the calorie is controlled by reflecting the current gain, the calorie is increased to increase the temperature. Accordingly, when the first control operation is performed, to prevent the temperature from being unnecessarily increased, the current gain is excluded in controlling calorie. In this case, the stage of the burner 140 is changed beyond the maximum control calorie range of the first stage. Accordingly, the first stage control RPM is a higher-power RPM than the second stage control RPM. When the stage of the burner 140 is changed to the second stage, the control operation is performed only in the minimum control calorie range. Accordingly, the second stage control RPM becomes a lower-power RPM than the first stage control RPM.

Meanwhile, the controller 110 maintains the target RPM of the blowing fan 130 to the second stage control RPM (lower-power RPM) and changes the stage to the first stage to the second stage. In addition, the controller 110 controls calorie by considering the current gain together, when performing the second control operation. In this case, the wording "the controller 110 controls calorie by considering the current gain" refers to that the current gain is included in the items for deriving control calorie. However, when the second control operation is performed, and when the calorie is controlled to a reference value or more, while the stage of the burner 140 is changed to the first stage to the second stage, the controller 110 may exclude the current gain from control items in controlling calorie, such that the calorie is prevented from being increased.

The controller 110 may consecutively determine the stage change count for the latest time of T2 while performing the stage change control operation. When the stage change count for the latest time of T2 is equal to or less than a second count (N2) (in this case, the second count is a value less than the first count (N1), the stage change control operation may be released.

Hereinafter, the operating flow of the boiler according to the present disclosure will be described in detail.

Figure 2:
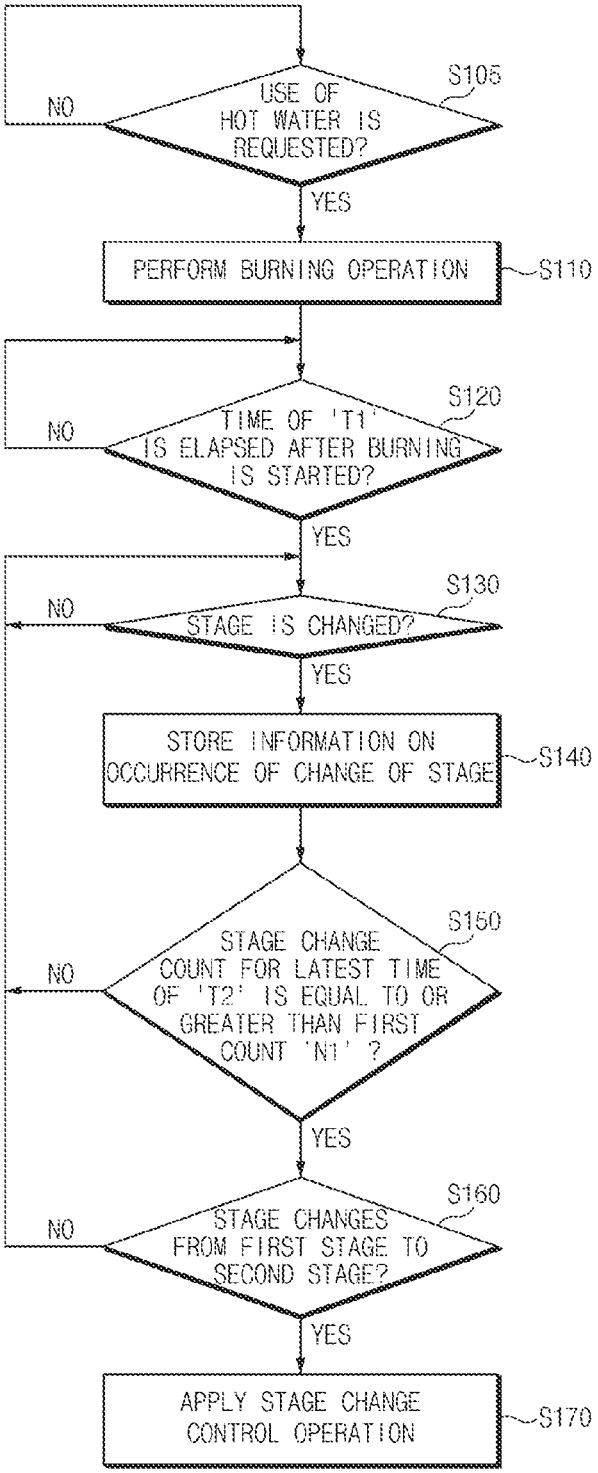
FIG. 2 is a flowchart illustrating a hot water control operation, according to an embodiment of the present disclosure.

FIG. 2 is a flowchart illustrating a hot water control operation, according to an embodiment of the present disclosure.

Referring to FIG. 2, the boiler 100 performs a burning operation to supply hot water (S110), when the use of the hot water is requested (S105). In S105, the boiler 100 may control the blowing fan 130 and the gas supply valve to supply air and gas to the burner 140. In this case, the hot water may be produced by heat generated by burning the mixture of the air and the gas through the burner 140. In this case, when the stage number is determined depending on calorie required, the burner 140 generates calorie corresponding to the stage number. For example, the burner 140 may be driven in the first stage at an initial operation.

The boiler 100 determines whether a stage is changed, when the time of 'T1' is elapsed after the burning is started (3120). The boiler 100 waits for the increase of the temperature until the time of 'T1' is elapsed because the temperature is not high right after the burning is started, and determines whether the stage of the burner 140 is changed from a time point at which the time of 'T1' is elapsed. For example, the boiler 100 may determine whether the stage of the burner 140 is changed from the time point at which the one minute is elapsed, right after the burning is started.

When the stage of the burner 140 is changed after the time point at which the time of 'T1' is elapsed (S130), the boiler 100 stores the information on the occurrence of the change of the stage (3140).

The boiler 100 determines whether the stage change count for the latest time of 'T2' from a current time point is equal to or greater than the first count (N1), based on the information on the occurrence of the change of the stage previously stored. When the stage change count for the latest time of 'T2' is less than the first count (N1) (S150), the boiler 100 may maintain a present operating state, and may store information on the occurrence of the change of the stage whenever the stage of the burner 140 is changed (S130 and S140).

Meanwhile, when the stage change count for the latest time of 'T2' from the current time point is equal to or greater than the first count 'N1' (S150), the stage change control operation may be applied to change the stage from the first stage to the second stage (S160 and S170).

In this case, the partial overlap section between a control calorie range of the first stage and a control calorie range of the second stage may be made. For example, on the assumption that the maximum control calorie of the first stage is 41%, and the minimum control calorie of the second stage is 31%, the section of 31% to 41% may be a section in which the control calorie of the first stage is overlapped with the control calorie of the second stage. Accordingly, the stage is frequently changed between the first stage and the second stage.

In particular, when the stage of the burner 140 is changed from the first stage to the second stage, higher load combustion may be made at the second stage in the burner 140 while the power of the blowing fan 130 is changed from the higher-power RPM region at the first stage to the lower-power RPM region at the second stage. In particular, the reaction speed becomes lower when the power is decreased, rather than when the power is increased, due to the characteristic of the blowing fan 130. Accordingly, although additional calorie of the burner 140 is increased, the temperature may be increased as in reference number 625 of FIG. 6A. Accordingly, the calorie may be dropped in the overlap sections between the control calorie of the first stage and the control calorie the second stage.

Accordingly, when the stage of the burner 140 is changed from the first stage to the second stage, the calorie is prevented from adding and the temperature is prevented from being increased. Accordingly, to stably change the stage, the stage change control operation is performed according to the present disclosure. However, the flow of the detailed operations of the stage change control operation will be understood with reference to FIGS. 3 to 5.

Figure 4:
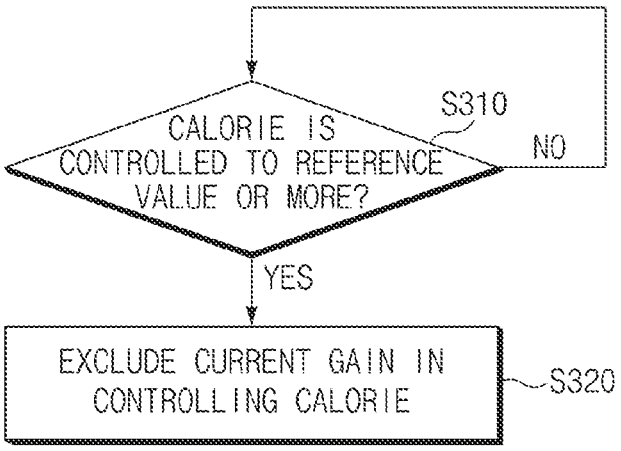
Figure 5:
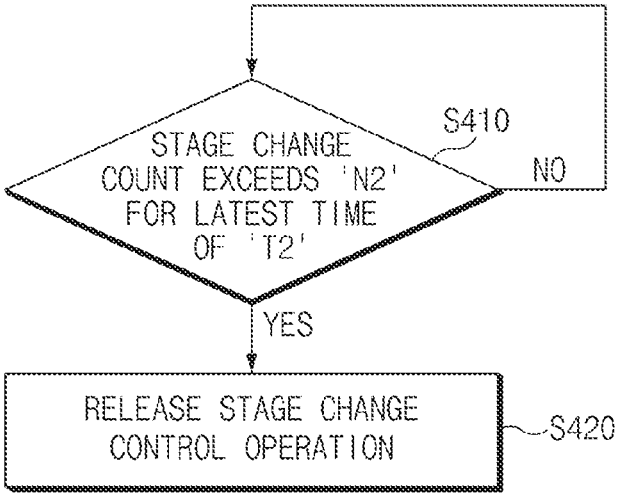
Figure 7:
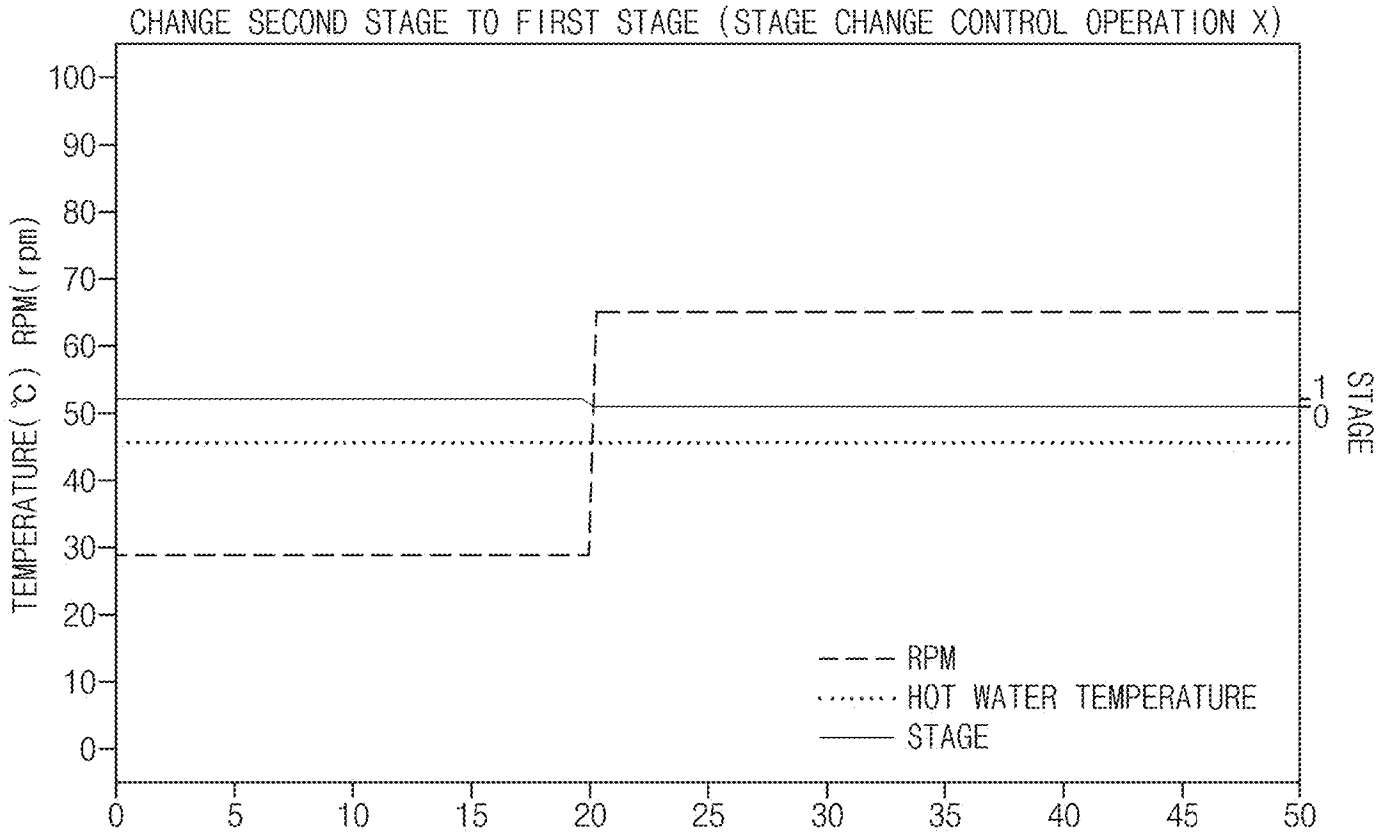

Meanwhile, the low load combustion of the first stage is made while the power of the blowing fan 130 is changed from the high-power RPM region of the first stage to the low-power RPM region of the second stage when the stage of the burner 140 is changed from the second stage to the first stage. However, when the stage of the burner 140 is changed from the second stage to the first stage, the blowing fan 130 has a rapid reaction speed due to the increase of the power. Accordingly, the change in the temperature may not be made as illustrated in FIG. 7. Accordingly, the stage change control operation may not be performed with respect to the change of the stage from the second stage to the first stage, FIGS. 3 to 5 are flowcharts illustrating a stage change control operation, according to an embodiment of the present disclosure.

Figure 3:
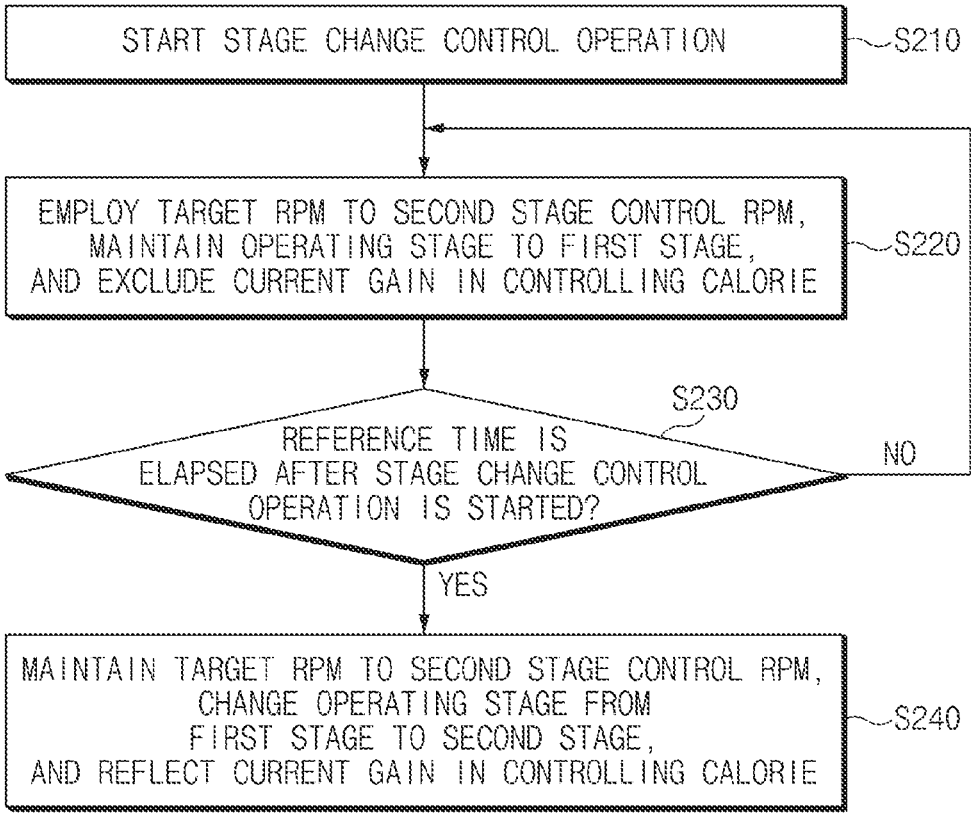
FIGS. 3, 4 and 5 are flowcharts illustrating a stage change control operation, according to an embodiment of the present disclosure.

First, referring to FIG. 3, the boiler 100 starts the stage change control operation, when the stage of the burner 140 is changed from the first stage to the second stage (S210).

In this case, the boiler 100 may perform the first control operation until the reference time is elapsed after the stage change control operation is started.

In this case, when the first control operation is performed, the boiler 100 employs the target RPM of the blowing fan 130 to the second stage control RPM (lower-power RPM), maintains the stage of the burner 140 to the first stage, and excludes a current gain from the control items to prevent the unnecessary temperature from being increased, when the calorie is controlled (S220). In this case, the RPM of the blowing fan 130 is adjusted to the lower-power RPM of the second stage from the higher-power RPM of the first stage during the reference time. During this time, the burner 140 is maintained to the first stage, thereby preventing the higher load combustion of the second stage from being made.

The boiler 100 may perform the second control operation, when the reference time is elapsed after the stage change control operation is started (S230).

In this case, when the second control operation is performed, the boiler 100 maintains the target RPM of the blowing fan 130 to the second stage control RPM (lower-power RPM), changes the stage of the burner 140 from the first stage to the second stage, and incorporates a current gain into control items, when calorie is controlled (S240).

In this case, the RPM of the blowing fan 130 is adjusted to almost the lower-power RPM of the second stage during S220. Accordingly, even if the stage of the burner 140 is changed to the second stage, the difference in control calorie is not great, so the change in the temperature may be reduced.

Referring to FIG. 4, the boiler 100 may determine whether the calorie is controlled to a reference value or more, while the stage of the burner 140 is changed from the first stage to the second stage, when the second control operation is performed in S240 of FIG. 3.

When the calorie is controlled to a reference value or more during the second control operation (S310), the current gain is excluded from the control items in the calorie control operation to prevent the calorie is prevented from being increased (S320).

Referring to FIG. 5, the boiler 100 may consecutively determine the stage change count for at least the time of T2 even during the stage change control operation when the stage of the burner 140 is changed from the first stage to the second stage.

When the stage change count exceeds the second count (N2) for the latest time of 'T2' during the stage change control operation (S410), the boiler 100 may consecutively apply the stage change control operation when the stage of the burner 140 is changed from the first stage to the second stage. In this case, the second count 'N2' has a value less than the first count 'N1'.

Meanwhile, when the stage change count exceeds the second count (N2) for the latest time of 'T2' during the stage change control operation (S410), the boiler 100 may release the stage change control operation (S420).

FIGS. 6A to 9B are views illustrating an operating effect based on the stage change control operation of the boiler, according to an embodiment of the present disclosure.

Figure 6A:
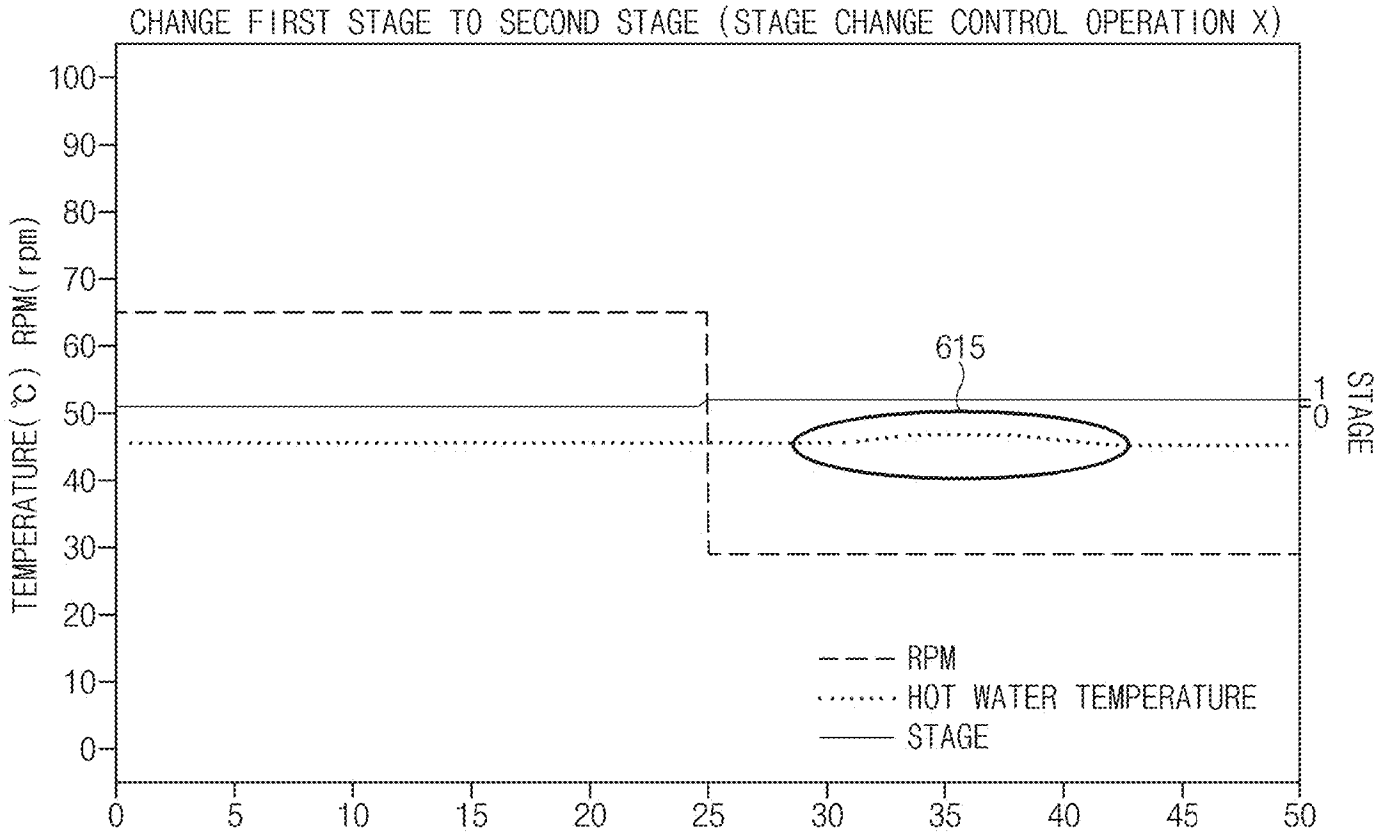
FIGS. 6A, 6B, 7, 8A, 8B, 9A to 9B are views illustrating an operating effect based on the stage change control operation of the boiler, according to an embodiment of the present disclosure.
Figure 6B:
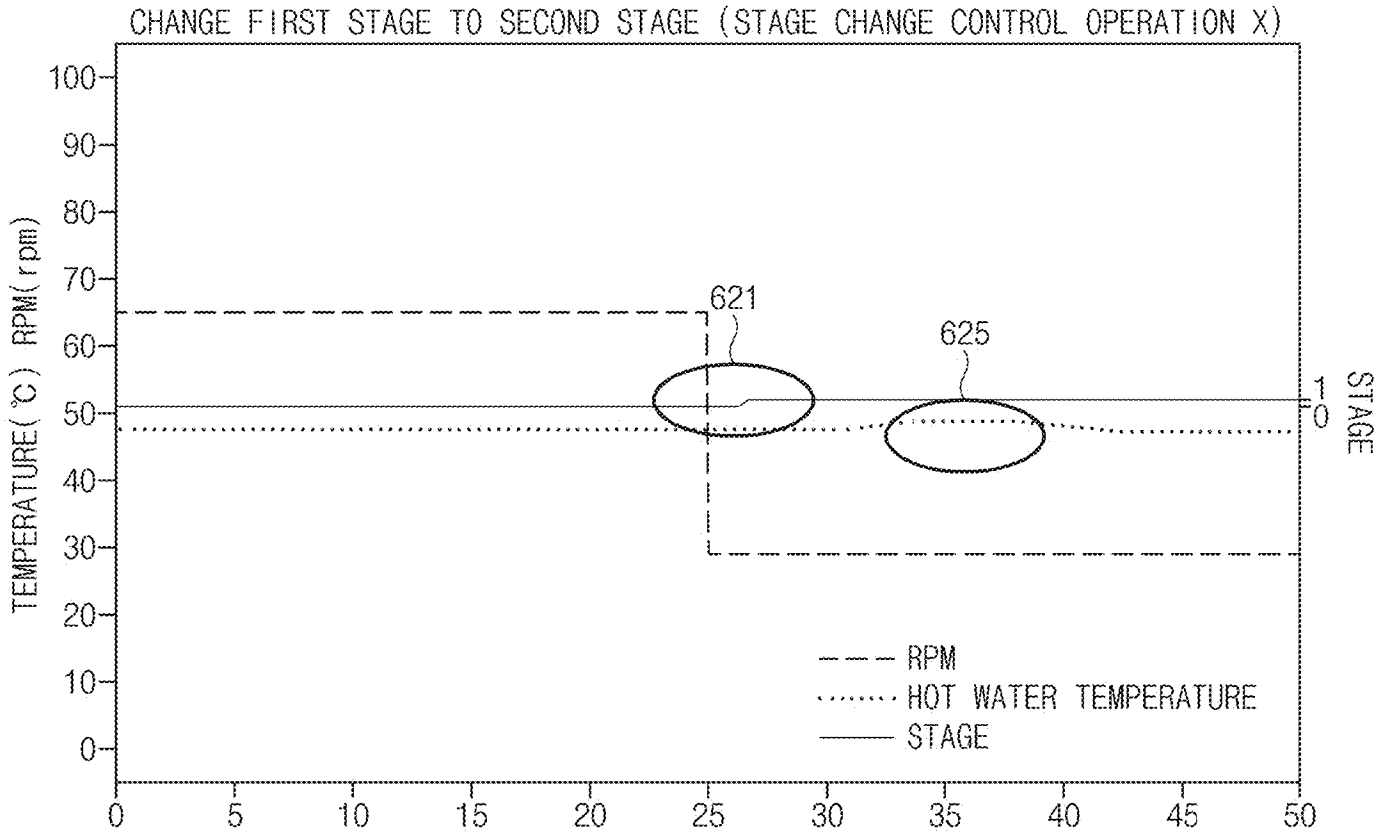

FIG. 6A is a view illustrating the change in parameter based on the stage changed from the first stage to the second stage before the stage change control operation is applied, and FIG. 6B is a view illustrating the change in parameter based on the stage changed from the first stage to the second stage after the stage change control operation is applied.

Referring to FIG. 6A, as the target RPM of the blowing fan 130 is changed from the first stage control RPM (higher-power RPM) to the second stage control RPM (lower-power RPM), when the stage of the burner 140 is changed from the first stage to the second stage before the stage change control operation is applied according to the present disclosure, the change of the stage is delayed until the RPM of the blowing fan 130 reaches the target RPM.

As the higher load combustion is made at the second stage in the burner 140 during the time to delay the change of the stage, the supply of added calorie is increased, so the temperature is increased.

For example, as illustrated in reference numeral 615 of FIG. 6A, it may be recognized that the temperature is increased by about 1.6° C., when the stage of the burner 140 is changed from the first stage to the second stage, before the stage change control operation is applied.

Meanwhile, referring to FIG. 6B, the change of the stage may be delayed until the RPM of the blowing fan 130 reaches the target RPM when the stage of the burner 140 is changed from the first stage to the second stage. For example, when the stage of the burner 140 is changed from the first stage to the second stage, about 1.5 seconds may be delayed as illustrated in reference numeral 621. In this case, according to the present disclosure, the stage change control operation is performed for the delayed time. According to the stage change control operation, the stage is not directly changed from the first stage to the second stage. The stage is maintained to the first stage before the stage of the burner 140 is changed to the second stage while the target RPM of the blowing fan 130 is reduced to the second stage control RPM in advance by applying the second stage control RPM, and then the stage of the burner 140 is changed to the second stage. Therefore, according to the present disclosure, when the stage of the burner 140 is changed from the first stage to the second stage, the difference in power is minimized to reduce an amount of calorie additionally introduced, thereby reducing the increment of the temperature when the stage is changed.

For example, as illustrated in reference numeral 625 of FIG. 6A, it may be recognized that the temperature may be increased by about 0.3° C., when the stage of the burner 140 is changed from the first stage to the second stage after the stage change control operation is performed. Accordingly, it may be recognized that the increment of the temperature is significantly reduced in FIG. 6B, as compare with that the temperature is increased by 1.6° C. when the stage of the burner 140 is changed as illustrated in FIG. 6A.

FIG. 7 is a view illustrating the change in parameter resulting from the change of stage from the second stage to the first stage before the stage change control operation is applied.

Referring to FIG. 7, the lower load combustion of the first stage is made such that the temperature may be decreased, while the power of the blowing fan 130 is changed to the high-power RPM region of the first stage from the low-power RPM region of the second stage when the stage of the burner 140 is changed from the second stage to the first stage. However, when the stage of the burner 140 is changed from the second stage to the first stage, the blowing fan 130 has a rapid reaction speed due to the increase of the power. Accordingly, the change in the temperature may not be made as illustrated in FIG. 7. Accordingly, the stage change control operation may not be performed with respect to the change of the stage from the second stage to the first stage.

According to the present disclosure, when the stage of the burner 140 is changed from the second stage to the first stage before the stage change control operation is performed, as the target RPM of the blowing fan 130 is changed from the second stage control RPM (lower-power RPM) to the first stage control RPM (higher-power RPM), the change of the stage is delayed until the RPM of the blowing fan 130 reaches to the target RPM. As the lower load combustion is made at the second stage in the burner 140 during the time to delay the change of the stage, the temperature is increased.

However, when the stage of the burner 140 is changed from the second stage to the first stage, the blowing fan 130 has the rapid reaction speed due to the increase of the power, the delayed time is reduced.

As described above, the delayed time when the stage of the burner 140 is changed from the second stage to the first stage is shorter than the delayed time when the stage of the burner 140 is changed from the first stage to the second stage as illustrated in FIG. 6A. Accordingly, it may be recognized that the temperature is hardly changed as the stage is rapidly changed.

Figure 8A:
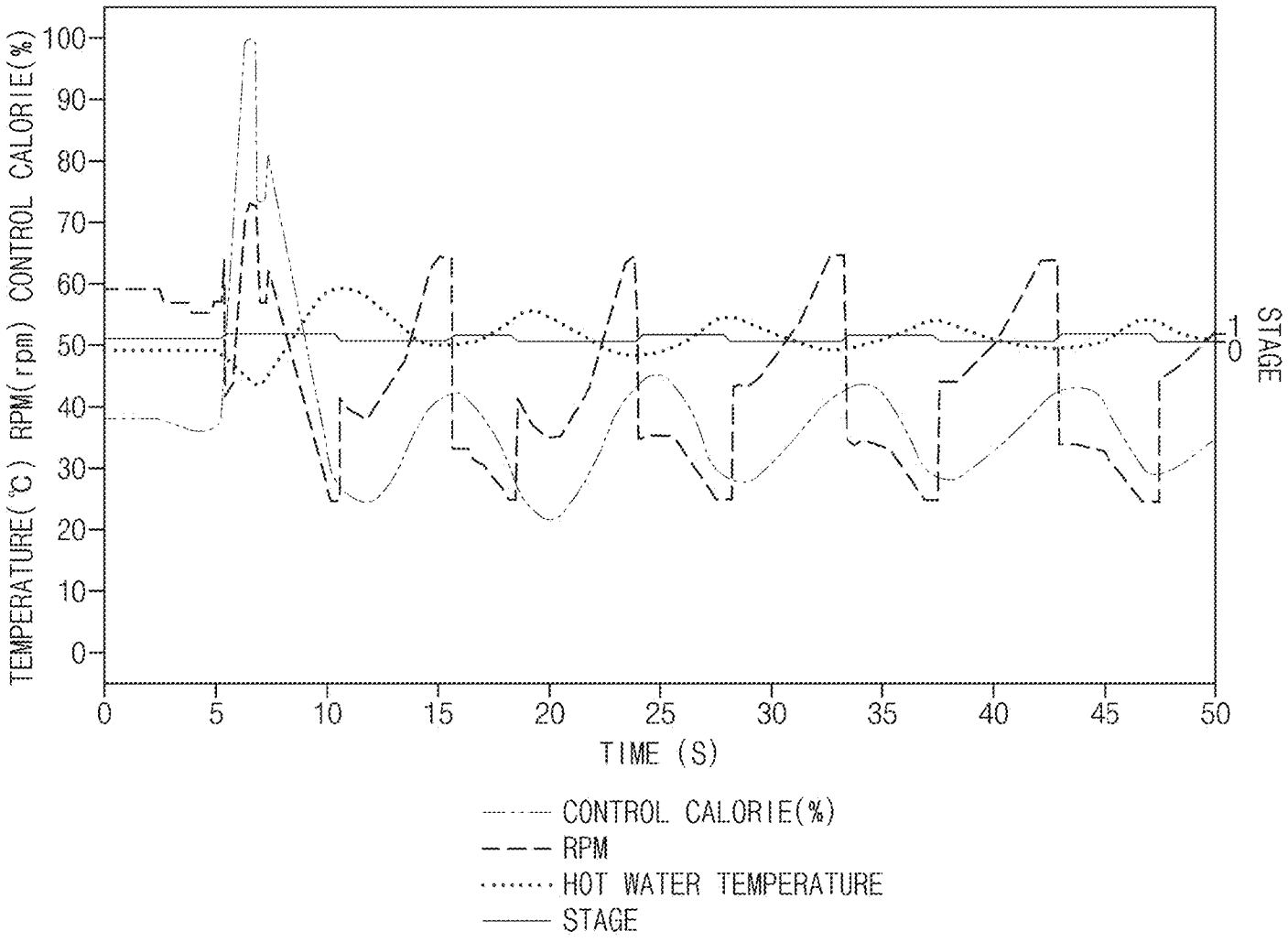
Figure 8B:
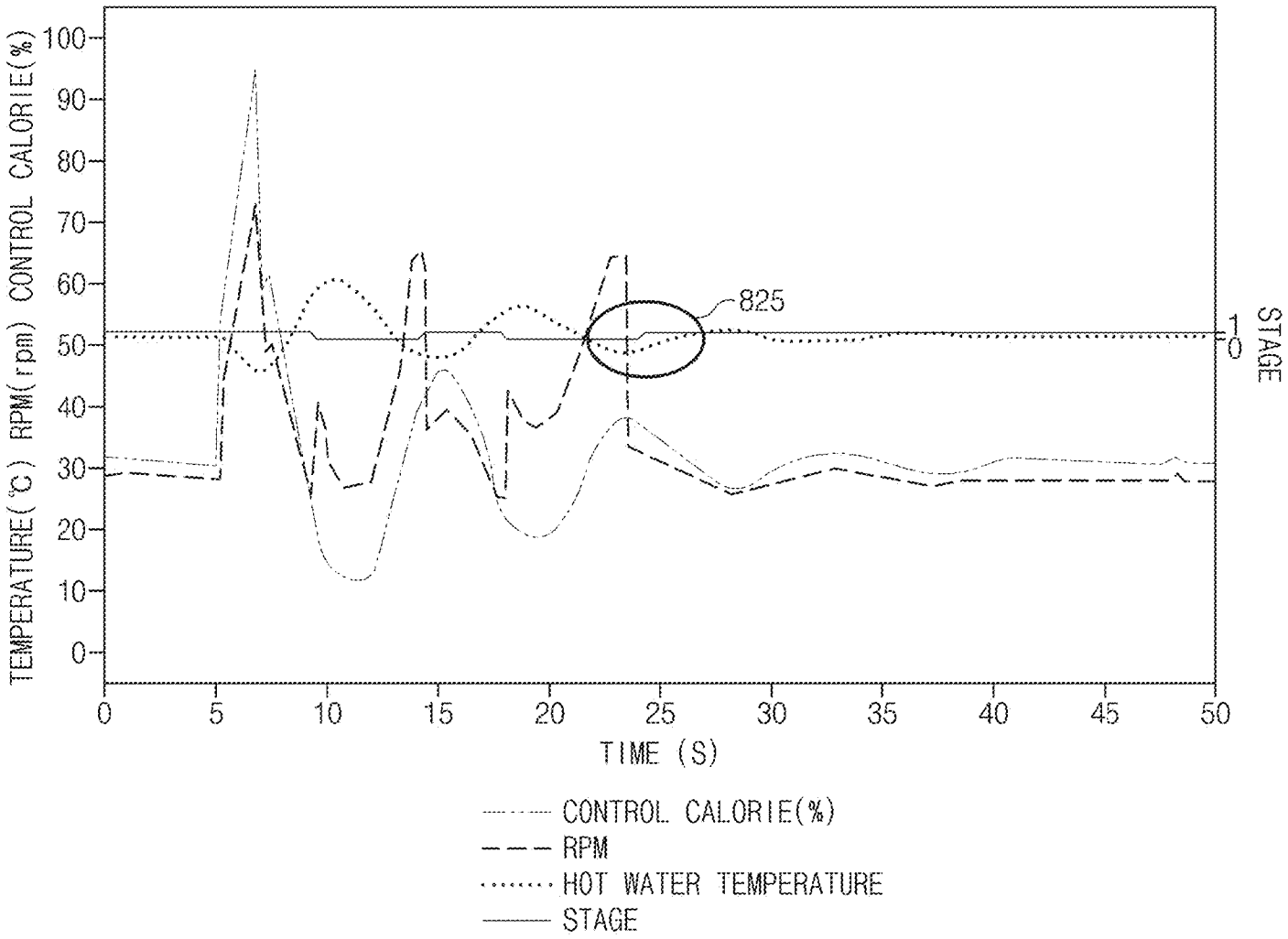

Accordingly, the boiler 100 may not perform the stage change control operation when the stage of the burner 140 is changed from the second stage to the first stage FIG. 8A illustrates the change in the operating state, when the stage change control operation is not applied during the initial operation time before a factor is updated, and FIG. 8B illustrates the change in the operating state, when the stage change control operation is applied during the initial operation time before the factor is updated.

Figure 9A:
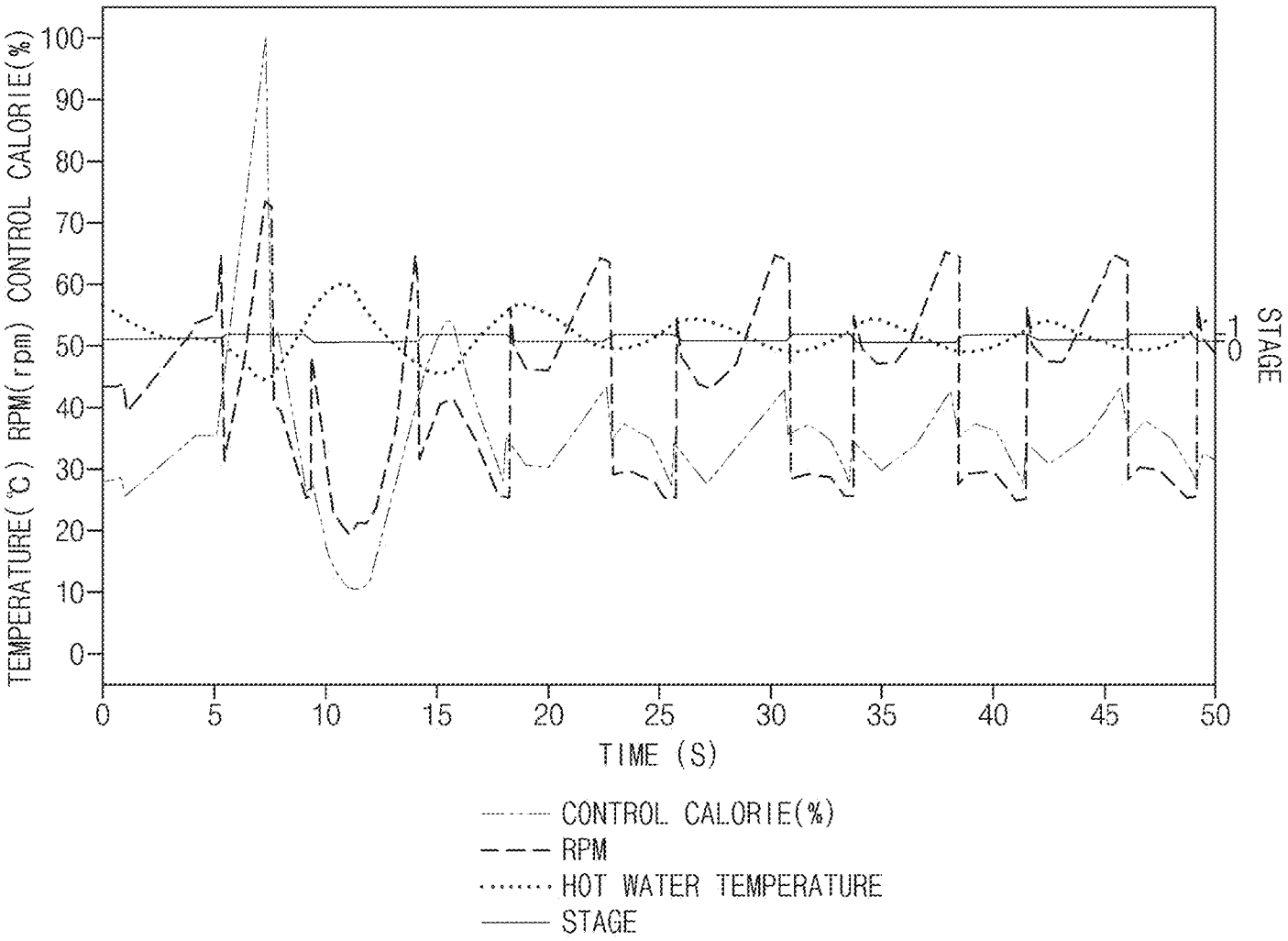
Figure 9B:
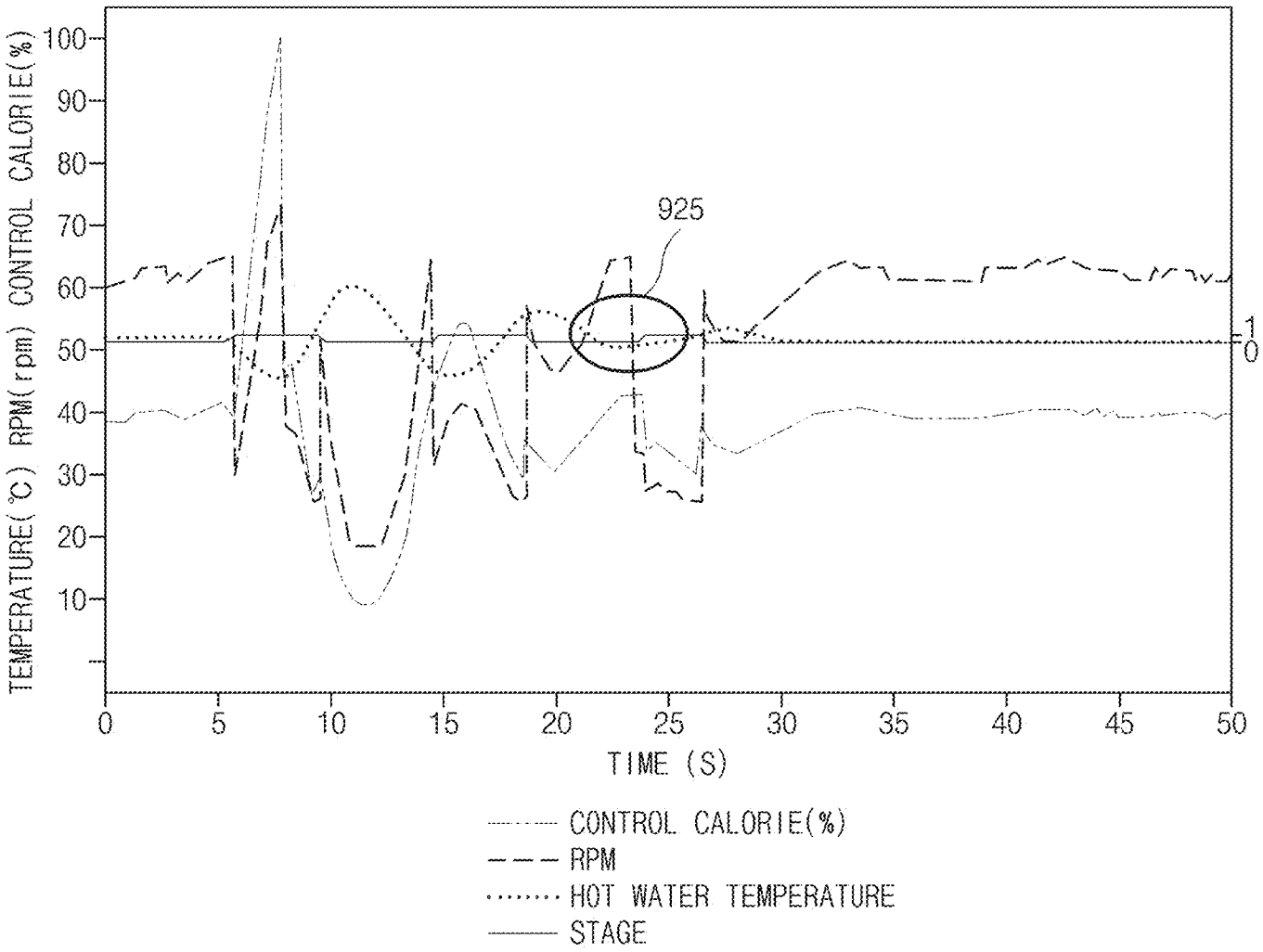

In addition, FIG. 9A illustrates the change in the operating state, when the stage change control operation is not applied after a factor is updated, and FIG. 9B illustrates the change in the operating state, when the stage change control operation is applied during the initial operation time after the Factor is updated.

Referring to FIGS. 8A to 9B, the RPM of the blowing fan, control calorie, and the state change in the temperature of hot water, when the stage is changed.

When the mixing control operation is performed when the hot water is supplied in the boiler 100, the temperature of the hot water is rapidly changed due to the difference in flow rate of water introduced into a hot water heat exchanger due to the change in the mixing rate.

As described above, as the temperature of the hot water is rapidly changed, the change in the calorie increased to match the target temperature of the hot water. Accordingly, the stage is frequently changed in the overlap section of control calorie at the first stage and the second stage.

Referring to FIG. 8A and FIG. 9A, it may be recognized that the stage is frequently changed before the stage change control operation is applied, and the calorie and the temperature of the hot water are consecutively changed, whenever the stage is changed. The phenomenon occurs during the initial operation time before the factor is updated, and after the factor is updated.

To the contrast, referring to FIGS. 8B and 9B, according to the present disclosure, the boiler 100 performs the stage change control operation, when the stage of the burner 140 is changed from the first stage to the second stage from the time point (see reference numerals 825 and 925) at which the stage change count for the latest time of 'T2' is equal to or greater than the first count.

For example, when the stage change count is equal to or greater than '3' for the latest time of one minute, the stage change control operation is performed when the stage of the burner 140 is changed from the first stage to the second stage thereafter, thereby stabilizing the calorie and the temperature of the hot water when the stage is changed.

It may be recognized from FIGS. 8B and 9B that the calorie and the temperature of the hot water are stabilized and the stage change count is reduced, due to the stage change control operation after the stage of the burner 140 is changed three times for one minute As described above, according to the present disclosure, in the boiler and the method for stage change control of the boiler, when the hot water is used in the boiler and when the stage of the burner 140 is changed from the first stage to the second stage in the overlap section in which the control calorie of the first stage is overlapped with the control calorie of the second stage, the target RPM of the blowing fan is reduced in advance at the first stage through the stage change control operation, and then the stage of the burner 140 is changed to the second stage, thereby minimizing the difference in calorie, such that the stage is stably changed.

According to the present disclosure, when the hot water of the boiler is used, the phenomenon of frequently changing the stage or dropping calorie is prevented.

In addition, according to the present disclosure, the stage may be stably changed, without correcting a cause of frequently changing the stage or of dropping calorie, or adding a part, when hot water of the boiler is used.

The above description is merely an example of the technical idea of the present disclosure, and various modifications and modifications may be made by one skilled in the art without departing from the essential characteristic of the invention.

Accordingly, embodiments of the present disclosure are intended not to limit but to explain the technical idea of the present disclosure, and the scope and spirit of the invention is not limited by the above embodiments. The scope of protection of the present disclosure should be construed by the attached claims, and all equivalents thereof should be construed as being included within the scope of the present disclosure.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A boiler comprising:

a burner configured to generate a calorie necessary for producing hot water by burning air and gas; and a controller configured to perform a stage change control operation, when the number of times, in which a stage in the burner is changed, is equal to or greater than a reference number of times, for a predetermined time, based on information on occurrence of the change of the stage in the burner, while hot water is used;

wherein the burner is configured to be driven in multiple stages; and wherein the controller is configured to:

perform the stage change control operation when the stage of the burner is changed from a first stage to a second stage;

perform a first control operation until a reference time is elapsed from a time point at which the stage change control operation is started, and perform a second control operation after the reference time is elapsed; and change a target revolution per minute (RPM) of a blowing fan, which supplies the air to the burner, to a second stage control RPM from a first stage control RPM while maintaining the stage of the burner to the first stage, when the first control operation is performed.

2. The boiler of claim 1, wherein the burner generates a calorie corresponding to a number of a stage in which the burner is driven.

3. The boiler of claim 1, wherein the controller is configured to:

store the information on the occurrence of the change of the stage, whenever the change of the stage occurs in the burner, from a time point at which a first time is elapsed after the burner starts burning.

4. The boiler of claim 3, wherein the controller is configured to:

maintain a present control state when the number of times, in which the stage of the burner is changed for a latest second time from a current time point, is determined as being less than a first count, based on the stored information on the occurrence of the change of the stage, and perform the stage change control operation, when the number of times, in which the stage is changed, is equal to or greater than the first count.

5. The boiler of claim 1, wherein the controller is configured to:

maintain the target RPM of the blowing fan, to the second stage control RPM and change the stage of the burner to the second stage from the first stage, when the second control operation is performed.

6. The boiler of claim 5, wherein the controller is configured to:

control the calorie by considering a current gain, when the second control operation is performed, and exclude the current gain in controlling the calorie, when the calorie is controlled to a reference value or more, while the stage of the burner is changed from the first stage to the second stage.

7. The boiler of claim 1, wherein the controller is configured to:

release the stage change control operation when the number of times, in which the stage of the burner is changed for a latest second time from the current time point, is equal to or less than a second count, while the stage change control operation is performed.

8. A method for stage change control of a boiler, the method comprising:

generating, by a burner driven in multiple stages, a calorie necessary for producing hot water by burning air and gas; and determining that the number of times, in which a stage in the burner is changed, is equal to or greater than a reference number of times, for a predetermined time, based on information on occurrence of the change of the stage in the burner, while hot water is used;

determining that the stage of the burner is changed from a first stage to a second stage; and performing a stage change control operation that includes:

performing a first control operation until a reference time is elapsed from a time point at which the stage change control operation is started;

performing a second control operation after the reference time is elapsed; and changing a target revolution per minute (RPM) of a blowing fan, which supplies the air to the burner, to a second stage control RPM from a first stage control RPM while maintaining the stage of the burner to the first stage, when the first control operation is performed.

9. The method of claim 8, wherein generating of the calorie includes generating a calorie corresponding to a number of a stage in which the burner is driven.

10. The method of claim 8, further comprising storing the information on the occurrence of the change of the stage, whenever the change of the stage occurs in the burner, from a time point at which a first time is elapsed after the burner starts burning.

11. The method of claim 10, wherein performing the stage change control operation includes:

maintaining a present control state upon determining that the number of times, in which the stage of the burner is changed for a latest second time from a current time point, is determined as being less than a first count, based on the stored information on the occurrence of the change of the stage, and performing the stage change control operation, upon determining that the number of times, in which the stage is changed, is equal to or greater than the first count.

12. The method of claim 8, wherein performing the second control operation includes:

maintaining the target RPM of the blowing fan to the second stage control RPM and changing the stage of the burner to the second stage from the first stage.

13. The method of claim 12, wherein performing the second control operation includes:

controlling the calorie by considering a current gain; and excluding the current gain in controlling the calorie, upon determining that the calorie is controlled to a reference value or more, while the stage of the burner is changed from the first stage to the second stage.

14. The method of claim 8, further comprising:

releasing the stage change control operation upon determining that the number of times, in which the stage of the burner is changed for a latest second time from the current time point, is equal to or less than a second count, while the controlling of the change of the stage is performed.

* * * * *